US006266900B1

(12) United States Patent
Bizzell

(10) Patent No.: US 6,266,900 B1
(45) Date of Patent: Jul. 31, 2001

(54) BACKFILL BLADE APPARATUS

(76) Inventor: Dana M. Bizzell, P.O. Box 501, Frankston, TX (US) 75763

( * ) Notice: Subject to any disclaimer, the term of this patent is extended or adjusted under 35 U.S.C. 154(b) by 0 days.

(21) Appl. No.: 09/635,228

(22) Filed: Aug. 9, 2000

(51) Int. Cl.[7] ..... E02F 3/08
(52) U.S. Cl. ..... 37/358; 37/363; 37/367
(58) Field of Search ..... 37/142.5, 355, 37/357, 358, 363, 367, 347, 189

(56) References Cited

U.S. PATENT DOCUMENTS

| | | | | |
|---|---|---|---|---|
| 3,807,067 | * | 4/1974 | Cloud | 37/142.5 |
| 3,908,292 | * | 9/1975 | Harris | 37/142.5 |
| 5,479,728 | * | 1/1996 | Deken et al. | 37/142.5 |
| 5,526,590 | * | 6/1996 | Palm et al. | 37/142.5 |
| 6,163,987 | | 12/2000 | Schommer | 37/407 |

* cited by examiner

*Primary Examiner*—Christopher J. Novosad
(74) *Attorney, Agent, or Firm*—Donald Casey, Esq.

(57) ABSTRACT

A blade assembly for a walk-behind trencher is described. The trencher includes a restraining bar which is affixed to the roller boom and which extends horizontally over the roller boom/digging chain assembly. When rotation of the digging chain is disengaged and the roller boom digger, including the retraining bar, is placed essentially horizontal position, the front end of the backfill blade assembly is mounted on the restraining bar and the rear end of the backfill blade assembly is releasably affixed to the side of the trencher. The trencher itself, after digging a trench, can raise the roller boom to which the restraining bar is attached to a horizontal position, the backfill blade assembly can be quickly installed and the trencher can then be positioned so as to drive over the trench pushing dirt from the side of the trench back into it. A stabilizing bar is longitudinally adjustable so that the backfill blade assembly can be used with differing roller boom lengths.

10 Claims, 3 Drawing Sheets

BACKFILL BLADE APPARATUS

FIELD OF THE INVENTION

This invention relates to walk-behind trenching machines ("trenchers") and in particular to a backfill blade attachment that enables such a trencher, after a trench has been dug and the invention then mounted on the trencher, to refill the trench that has been dug.

DESCRIPTION OF THE PRIOR ART

Machines for digging trenches have been use for many years. They are designed either to be towed by a tractor (or some other vehicle) or are self-propelled. In either case, a continuous chain loop fitted with extending teeth, rotates on a power driven roller boom to dig the trench. Trenching machines typically are designed so as to deposit dirt from the trench on one side of the trench. The trenchers are used for utility lines of various kinds such as water, gas, electrical or communications cables and sewer systems. When a trench has been dug and the cable placed therein, the trench is usually refilled manually or by a separate tractor fitted with a front or rear mounted blade.

Walk-behind trenchers, all of which are self-propelled, are substantially smaller than tractor mounted or tractor pulled trenchers. Walk-behind trenchers are used frequently in residential construction and in a variety of other tasks where use of larger duty trenchers is neither necessary nor practical. At present, walk-behind trenchers seldom, if ever, are fitted with a means to refill the trench. In the material that follows, it should be noted that the operator of a walk-behind trencher digs the trench by guiding the trencher to his rear. Use of the term "walk-behind", therefore, is somewhat of a misnomer.

Elaborate filler attachments for trenchers are described, for example, in U.S. Pat. Nos. 3,807,067, 3,908,292 and 5,479,728. These patents describe the use of a drag conveyor or a horizontally mounted auger that moves dirt laterally to refill the trench, and also could include a tamper. U.S. Pat. No. 5,526,590 describes a vibrating compactor wherein a blade is used for backfilling. The backfilling attachment is linked so as to be movable and includes two blades that are set as wings on either side of the compactor. The device includes hydraulic cylinders to raise and lower the blade.

A need exists for an efficient, rugged, simple and relatively light weight device that can be quickly and easily installed on walk-behind trenchers to refill the trenches dug by them.

SUMMARY OF THE INVENTION

After a trench has been dug, this discovery provides a means whereby a backfill blade assembly, which can be installed on a walk-behind trencher at the free end of the roller boom/digger chain assembly by using only a slidable mounting sleeve and a stabilizing bar, enables the trencher under its power to refill the trench.

This attachment, in the preferred embodiment, is well suited for use with all walk-behind trenchers manufactured or sold in the United States, including those of the manufacturer believed to have far and away the largest market share of walk-behind trencher sales. All walk-behind trenchers have a restraining bar extending over the digger chain. This restraining bar is an integral part of the roller boom/digger chain assembly, such assembly is often hereinafter referred to as the "roller boom digger". The blade utilized in this invention, at its front, is assembled by a slidable coupling with the restraining bar. An adjustable stabilizing bar is used so that the back end of the blade is also affixed to the trencher. The blade assembly, which typically is disposed at about a 35 degree angle to the longitudinal axis of the trencher, is held in place by mounting one end on the restraining bar and the other end on the frame of the trencher.

In use, then, after the trench has been dug and after placement in the trench of the intended pipe, wire or cable, rotation of the chain is disengaged, the roller boom digger is raised so as to be substantially parallel with the ground, and the backfill blade assembly of this invention is mounted to the free end of the roller boom digger. The operator, then, leaving the digger chain disengaged so that is remains stationary, changes the direction of the trencher to forward. This invention, acting as an extension of the roller boom digger, is used to push the recently dug dirt disposed along the edge of the trench back into the trench as the trencher moves forward. The hydraulic system of the trencher which lowers the boom for purposes of digging is used to set the height of the boom, in relationship to the ground, at the most advantageous essentially horizontal position for pushing the dirt back into the trench.

Accordingly, there are several primary objects or purposes of this invention. They are as follows:

1. To provide a method for backfilling a trench whereby the same power sources used to dig the trench can, through installation of a backfill blade assembly on the trencher, be used to push the dirt disposed along the side of the trench back into the trench.
2. To provide a backfill blade assembly capable of ready adjustment so as to be usable with walk-behind trenchers of different sizes that may be required for digging trenches of different depths and widths.
3. To make mounting and dismounting of the backfill blade assembly onto and off the trencher, as the case may be, so easy and quick that anyone capable of operating the trencher can accomplish the task with a minimum of effort.

These and other objects will become readily apparent with reference to the drawings and following description:

DETAILED DESCRIPTION OF THE INVENTION

Figure 1:
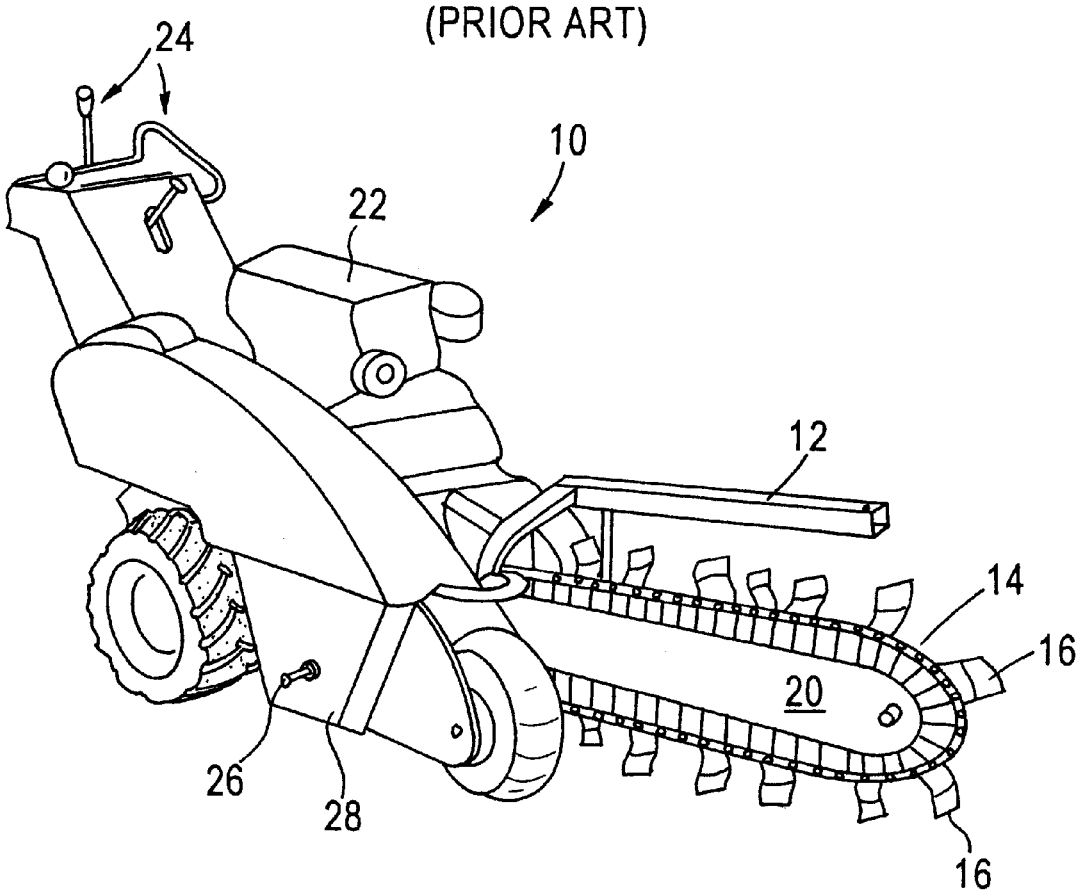
FIG. 1 (PRIOR ART)
FIG. 1 is a perspective view of a walk-behind trencher as is generally in use.

With attention to FIG. 1, a commercially available walk-behind trencher stylized to resemble a trencher made by the largest manufacturer of walk-behind trenchers is shown. This trencher 10 incorporates as part of the roller boom 20 a restraining bar 12 which typically is hollow tubular steel, square pipe, construction. The trencher utilizes a continuous chain 14 with digging teeth 16 that rotates on a roller boom 20. The restraining bar 12, the continuous chain 14 with digging teeth 16 and the roller boom 20 operate in concert as the roller boom/digging chain assembly, all of which, i.e. 12, 14, 16 and 20, when operating in concert are often referred to herein as the "roller boom digger". The roller boom digger is disposed, in this view, horizontally. When the roller boom digger is depressed by hydraulic action of the trencher and motorized power is applied to move the trencher to the operator's rear, a trench is dug. The trench is self-propelled by a motor under cowling 22. There are also the typical controls 24 that are utilized by the operator (not shown) who walks backward behind the trencher when it is operated in the digging mode.

A stabilizing pin 26 is provided on the side of the device 10. Except for a hole which is drilled in the restraining bar to accommodate a bolt or similar pin 40, the stabilizing pin 26 is the only addition or change to the commercial unit needed for mounting the backfill blade assembly of this invention.

Figure 2:
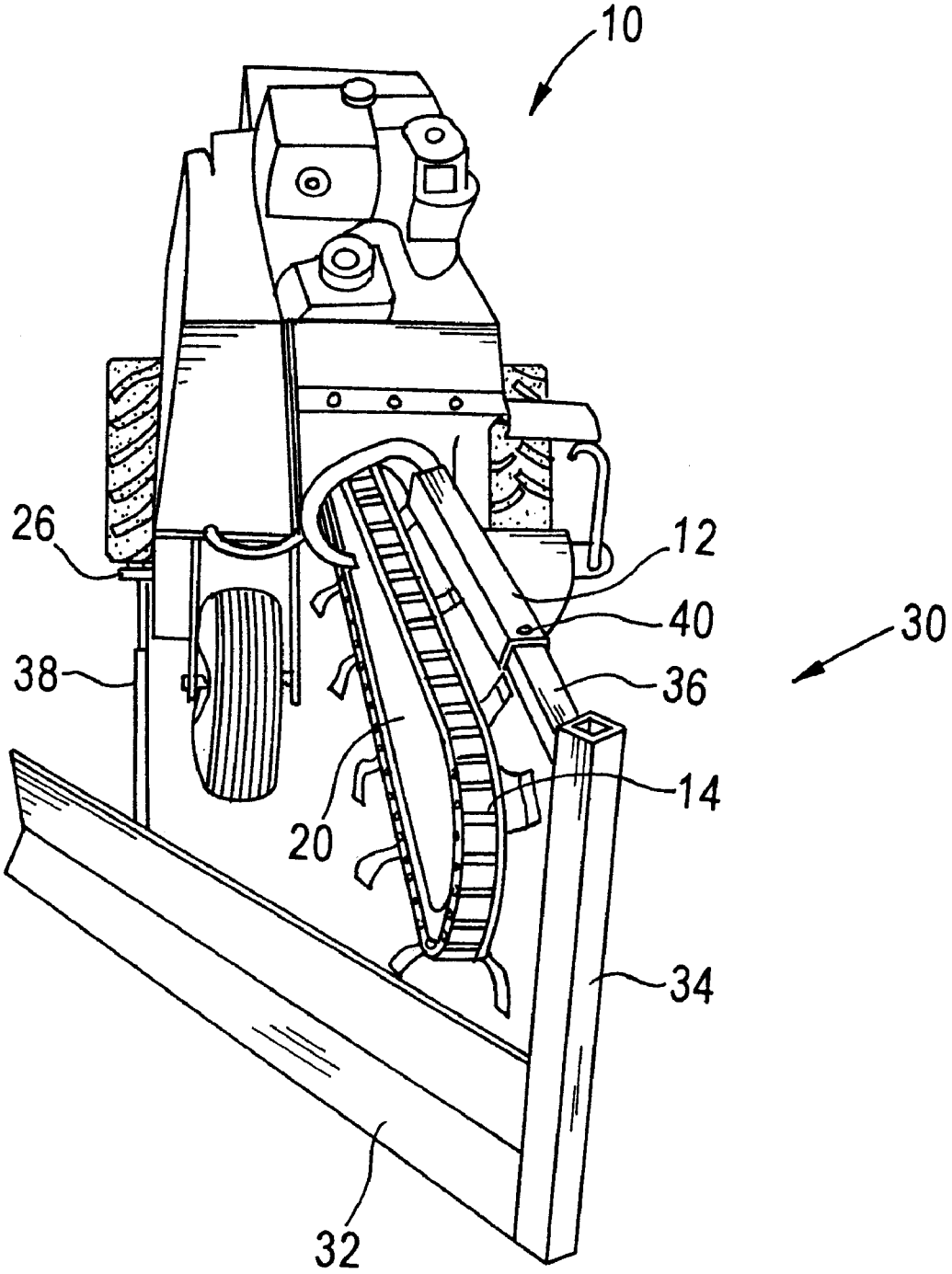
FIG. 2 is a perspective view of the trencher from a slightly different angle with the backfill blade assembly of this invention mounted thereon.
Figure 3:
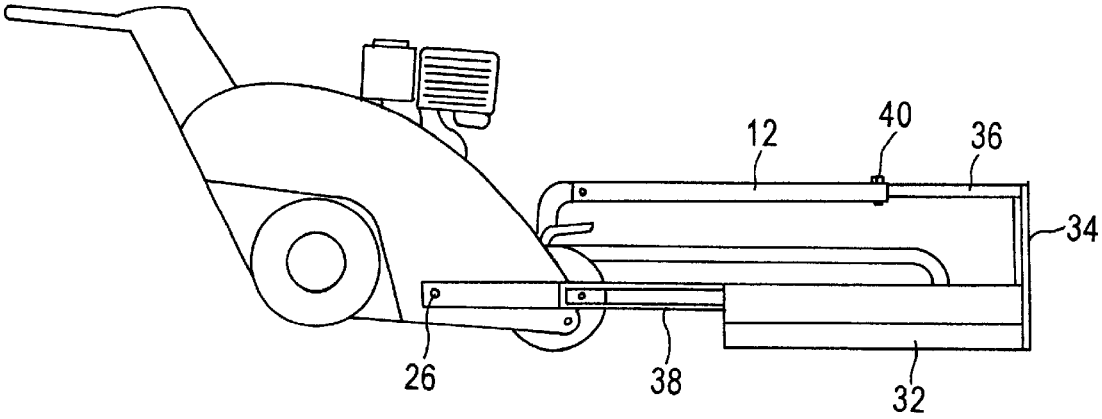
FIG. 3 is a side view of the trencher and mounted backfill blade assembly and attachment of FIG. 2.

With attention to FIGS. 2 and 3, the backfill blade assembly of this invention 30 includes the blade 32. The blade 32 is typically disposed at about a 35 degree angle to the longitudinal axis of the trencher 10 (A-A). The blade 32 is mounted at its forward end by a vertical mast 34 to which the forward end of the blade 32 is welded as is attaching tube 36 which extends substantially horizontally to the rear from the upper portion of the vertical mast 34 so as to slide into the hollow restraining bar. The opposite end of the blade 32 mounts a stabilizing bar 38 which is attached at one end to the pin 26. The surface of the blade 32 is dished out at an angle of approximately 150 degrees which assists in pushing dirt back into the trench more evenly and efficiently.

Figure 4:
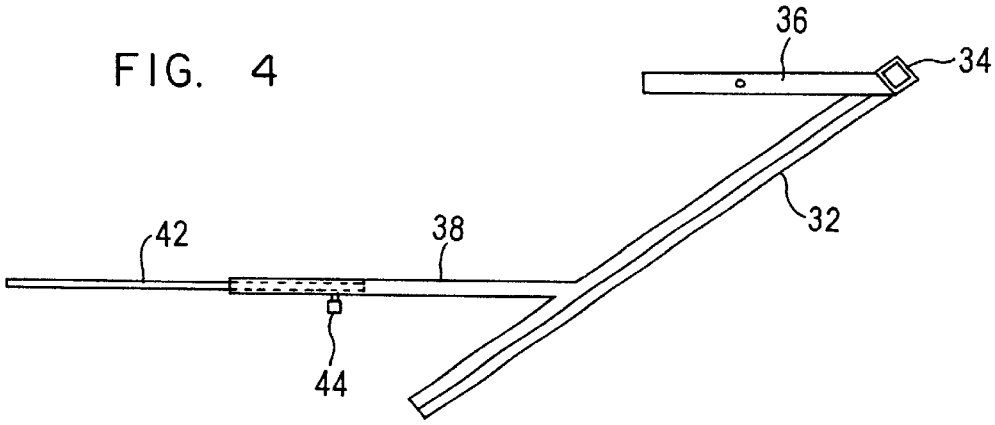
FIG. 4 is a top view of the backfill blade assembly only.
Figure 5:
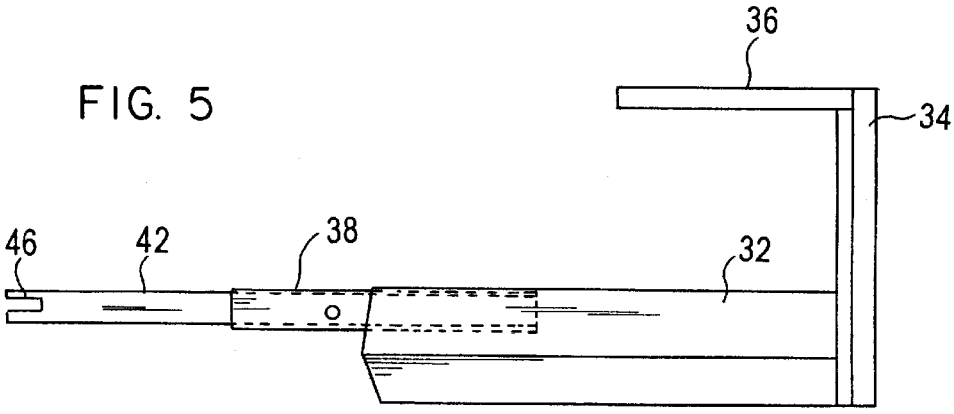
FIG. 5 is a side view of the backfill blade assembly of FIG. 4.

With attention to FIGS. 3, 4 and 5, the attaching tubing 36 which is received in the restraining bar 12 is secured with a bolt or similar pin 40. Stabilizing bar 38 has a telescoping member 42 held in place, for example, with a set screw 44, so that the position of the blade 32 can be moved horizontally forward or backward by the telescopic stabilizer bar 38. The telescoping portion 42 terminates in a slot 46 which receives pin 26 when the backfill blade assembly 30 is mounted on the trencher 10.

The only connections between the backfilling blade 30 and trencher 10 are the tube 36 received in the stabilizing bar 12 secured with pin 40, and the slot 46 in the stabilizing bar 42 which engages pin 26. Therefore, backfill blade assembly can be quickly mounted onto or dismounted from the trencher 10 with a minimum of effort and tools.

A separate tamper is not part of this invention and normally is not required for jobs of the type where the invention will be used.

It will be readily seen by one of ordinary skill in the art that the present invention fulfills all of the objects set forth above. After reading the foregoing specification, one of ordinary skill will be ably to effect various changes, substitutions or equivalents and various other aspects of the invention as broadly disclosed herein. It is therefore intended that the protection granted hereon be limited only by the definition contained in the appended claims and equivalents thereof.

What is claimed:

1. In a walk-behind self-propelled trencher having an elongated endless digging chain that rotates on a roller boom extending therefrom with a hollow horizontal restraining bar attached thereto and extending thereover, and all of which comprise a roller boom/digging chain assembly of said trencher, the improvement comprising:

a removable backfill blade assembly mounted on said trencher in front of the said roller boom assembly for refilling a trench dug by said trencher, said assembly including a blade being disposed at an acute angle to a longitudinal axis of roller boom assembly and having a front end and a rear end;

a mast vertically mounted on the front end of said blade and from the top of which a horizontal rod extends back toward the restraining bar to provide a releasable coupling means coupling said mast to said restraining bar;

a horizontal stabilizing bar affixed at one end to the rear end of said blade and releasably secured at the opposite end to said trencher, said stabilizing bar extending substantially parallel to a longitudinal axis of said roller boom assembly; and said mast being dimensioned to suspend and position said blade horizontally in front of said roller boom assembly and said stabilizing bar being dimensioned to hold said blade at an acute angle to a longitudinal axis of said roller boom assembly.

2. The assembly of claim 1 wherein said stabilizing bar is longitudinally adjustable relative to said assembly.

3. The assembly of claim 1 wherein said blade is held at an angle of about 35 degrees to a longitudinal axis of said roller boom assembly.

4. The assembly of claim 3 wherein said blade in cross section has a front face dished-out at an angle of about 150 degrees.

5. The assembly of claim 1 wherein said restraining bar has an open end of the hollow restraining bar enables said rod extending horizontally from the top of said mast being slidably received in said hollow restraining bar to form said coupling means.

6. The assembly of claim 5 wherein said coupling means further includes a pin extending through said restraining bar and the end of said rod received therein.

7. The assembly of claim 1 wherein said stabilizing bar is adjustable longitudinally and has a locking means therein for locking said bar at desired lengths.

8. The assembly of claim 7 further comprising a mounting pin on said trencher, said stabilizing bar having a slotted end and said pin being received in said slotted end to mount said bar on said trencher.

9. A method for filling a trench dug by a self-propelled, walk-behind trencher having a roller boom digger comprising:

providing a backfill blade having a front and a rear end;

releasably mounting said backfill blade assembly at both ends on said trencher wherein the front end of said blade assembly is slidably coupled to the front of said trencher, said blade assembly being coupled to a restraining bar;

orienting said roller boom digger and said backfill blade assembly substantially horizontally; and propelling said trencher and said blade assembly forward.

10. The method of claim 9 further comprising releasably coupling the rear end of said blade assembly to said trencher so that said blade will be mounted at an acute angle to a longitudinal axis of said said roller boom digger.

* * * * *